US010516935B2

(12) United States Patent
Wiederholtz et al.

(10) Patent No.: US 10,516,935 B2
(45) Date of Patent: Dec. 24, 2019

(54) HYBRID TRANSDUCER

(71) Applicant: Knowles Electronics, LLC, Itasca, IL (US)

(72) Inventors: Erik Wiederholtz, St. Charles, IL (US); David Prince, Lombard, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/745,012

(22) PCT Filed: Jul. 12, 2016

(86) PCT No.: PCT/US2016/041906

§ 371 (c)(1),
(2) Date: Jan. 15, 2018

(87) PCT Pub. No.: WO2017/011461

PCT Pub. Date: Jan. 19, 2017

(65) Prior Publication Data

US 2018/0213318 A1 Jul. 26, 2018

Related U.S. Application Data

(60) Provisional application No. 62/192,901, filed on Jul. 15, 2015.

(51) Int. Cl.
*H04R 1/10* (2006.01)
*H04R 1/24* (2006.01)
(Continued)

(52) U.S. Cl.
CPC ..... *H04R 1/24* (2013.01); *H04R 1/1008* (2013.01); *H04R 9/046* (2013.01); *H04R 9/06* (2013.01);
(Continued)

(58) Field of Classification Search
CPC ..... H04R 1/24; H04R 1/1008; H04R 9/06; H04R 9/063; H04R 9/046; H04R 11/02;
(Continued)

(56) References Cited

U.S. PATENT DOCUMENTS 3,432,622 A 5/1965 Sebesta et al.
3,230,426 A 1/1966 Sawyer et al.
(Continued)

FOREIGN PATENT DOCUMENTS

CN 205596313 9/2016
EP 0272616 12/1987
(Continued)

OTHER PUBLICATIONS

European Patent Office; International Search Report and Written Opinion; International Application No. PCT/US2016/061572; dated Feb. 15, 2017.
(Continued)

*Primary Examiner* — Jesse A Elbin
(74) *Attorney, Agent, or Firm* — Faegre Baker Daniels LLP

(57) ABSTRACT

A first acoustic transducer has an armature, and the armature moves within a magnetic field. The first transducer also comprises a first coil. A second acoustic transducer has a first outer circumferential edge and an inner circumferential edge. A housing includes at least portions of the first transducer and the second transducer. The first transducer is disposed at least partially within the cavity and within the inner circumferential edge of the second transducer. The first coil is fixed in space relative to the housing.

19 Claims, 6 Drawing Sheets

(51) Int. Cl.

| | |
|---|---|
| ***H04R 9/04*** | (2006.01) |
| ***H04R 9/06*** | (2006.01) |
| ***H04R 11/02*** | (2006.01) |
| ***H04R 25/00*** | (2006.01) |

(52) U.S. Cl.
CPC ..... *H04R 9/063* (2013.01); *H04R 11/02* (2013.01); *H04R 25/405* (2013.01); *H04R 25/604* (2013.01); *H04R 2209/041* (2013.01)

(58) Field of Classification Search
CPC ..... H04R 25/405; H04R 25/604; H04R 2209/041; H04R 3/12
USPC ..... 381/182, 184, 417, 418
See application file for complete search history.

(56) References Cited

U.S. PATENT DOCUMENTS

| | | | |
|---|---|---|---|
| 3,617,654 | A | 11/1971 | Heidrich |
| 3,660,772 | A | 5/1972 | Holt |
| 3,777,078 | A | 12/1973 | Boustros et al. |
| 3,801,933 | A | 4/1974 | Teare |
| 3,927,383 | A | 12/1975 | Fjarlie et al. |
| 4,054,965 | A | 10/1977 | Vig |
| 4,063,050 | A | 12/1977 | Carlson et al. |
| 4,151,480 | A | 4/1979 | Carlson et al. |
| 4,201,953 | A | 5/1980 | Robbins |
| 4,272,654 | A | 6/1981 | Carlson |
| 4,319,098 | A | 3/1982 | Baitcher |
| 4,518,831 | A | 5/1985 | Stanley et al. |
| 4,689,819 | A | 8/1987 | Killion |
| 4,754,232 | A | 6/1988 | Sasaki |
| 5,083,095 | A | 1/1992 | Madaffari |
| 5,097,224 | A | 3/1992 | Madaffari et al. |
| 5,193,116 | A | 3/1993 | Mostardo |
| 5,255,094 | A | 10/1993 | Yong et al. |
| 5,255,328 | A | 10/1993 | Akiniwa |
| 5,337,011 | A | 8/1994 | French et al. |
| 5,337,033 | A | 8/1994 | Kinouchi et al. |
| 5,398,398 | A | 3/1995 | Williams et al. |
| 5,461,677 | A | 10/1995 | Raj |
| 5,524,150 | A | 6/1996 | Sauer |
| 5,647,013 | A | 7/1997 | Salvage |
| 5,708,726 | A | 1/1998 | Brinkley et al. |
| 5,757,946 | A | 5/1998 | Van Schyndel |
| 5,805,040 | A | 9/1998 | Corcoran |
| 5,861,779 | A | 1/1999 | Loeppert et al. |
| 6,040,397 | A | 3/2000 | Hooper et al. |
| 6,041,131 | A | 3/2000 | Kirchhoefer et al. |
| 6,353,344 | B1 | 3/2002 | Lafort |
| 6,617,925 | B2 | 9/2003 | Hoang |
| 6,654,477 | B1 | 11/2003 | Miller et al. |
| 6,714,081 | B1 | 3/2004 | Xu |
| 7,634,096 | B2 | 12/2009 | Fallesen |
| 7,679,448 | B1 | 3/2010 | McAdam et al. |
| 7,920,027 | B2 | 4/2011 | Keerti |
| 8,970,307 | B2 | 3/2015 | Marra |
| 9,191,731 | B2 * | 11/2015 | Huang ..... H04R 1/24 |
| 9,258,630 | B2 * | 2/2016 | Chu ..... H04R 9/025 |
| 9,438,175 | B2 | 9/2016 | Onizuka |
| 9,843,292 | B2 | 12/2017 | Jennings et al. |
| 2003/0128856 | A1 | 7/2003 | Boor |
| 2005/0078841 | A1 | 4/2005 | Boor |
| 2005/0213787 | A1 | 9/2005 | Collins |
| 2005/0242791 | A1 | 11/2005 | Rajapandian et al. |
| 2006/0023903 | A1 * | 2/2006 | Hayashi ..... H04R 1/24 381/182 |
| 2008/0002841 | A1 | 1/2008 | Baker et al. |
| 2011/0025422 | A1 | 2/2011 | Marra et al. |
| 2011/0038503 | A1 * | 2/2011 | Yang ..... H04R 1/22 381/380 |
| 2011/0050345 | A1 | 3/2011 | Quack |
| 2011/0056302 | A1 | 3/2011 | Lutz |
| 2014/0266458 | A1 | 9/2014 | Scott |
| 2015/0035605 | A1 | 2/2015 | Lam |
| 2015/0214908 | A1 | 7/2015 | Kim |
| 2015/0244328 | A1 | 8/2015 | Toivonen |
| 2018/0332404 | A1 | 11/2018 | Badillo |

FOREIGN PATENT DOCUMENTS

| | | | |
|---|---|---|---|
| EP | 0548579 | A1 | 6/1996 |
| EP | 0982971 | A2 | 1/2000 |
| EP | 1331835 | A2 | 7/2003 |
| EP | 2421281 | A2 | 2/2012 |
| EP | 2744222 | A2 | 6/2014 |
| JP | 60160711 | | 8/1985 |
| JP | 2006229336 | A | 8/2006 |
| WO | 8302862 | A1 | 8/1983 |
| WO | 2005/039046 | A1 | 4/2005 |
| WO | 2005/104603 | A1 | 11/2005 |
| WO | 2007/103401 | A1 | 9/2007 |
| WO | 2014/107843 | A1 | 7/2014 |
| WO | 2017/083679 | A1 | 5/2017 |

OTHER PUBLICATIONS

Van Der Donk et al.; Amplitude-modulated electro-mechanical feedback system for silicon condenser microphones; Journal of Micromechanics & Microengineering, Institute of Physics Publishing; vol. 2, No. 3; Sep. 1, 1992.

Van Der Donk et al.; Preliminary results of a silicon condenser microphone with internal feedback; Transducers; Jun. 24, 1991.

European Patent Office; International Search Report; International Application No. PCT/US2004/033997; dated Mar. 17, 2005.

European Patent Office; International Preliminary Report on Patentability; International Application No. PCT/US2016/041906; dated Jan. 25, 2018.

Sedra, Adel S. et al.; Microelectronic Circuits; Oxford University Press; New York, p. 382; 1998.

* cited by examiner

HYBRID TRANSDUCER

CROSS-REFERENCE TO RELATED APPLICATION

This patent claims benefit under 35 U.S.C. § 119 (e) to U.S. Provisional Application No. 62/192,901 entitled "Hybrid Transducer" filed Jul. 15, 2015, the content of which is incorporated herein by reference in its entirety.

TECHNICAL FIELD

This application relates to transducers and, more specifically, to hybrid transducers.

BACKGROUND

Various types of receivers (transducers or speakers) have been used through the years. In these devices, different electrical components are housed together within a housing or assembly. Transducers can be used in many applications such as hearing instruments. These devices may be used in other applications such as personal audio devices, earphones, headphones, wearables, or cellular telephones as well.

Speakers convert electrical signals into sound energy. Various types of speakers exist. For example, a balanced armature receiver typically includes a coil, a yoke (or stack), and an armature, which together form a magnetic circuit, all housed within a housing. The armature is a moving component and moves as an electrical current creates a changing magnetic field in the receiver. Movement of the armature moves a drive rod. Movement of the drive rod moves a diaphragm and the movement of the diaphragm creates sound energy.

Another type of receiver is a dynamic speaker. The dynamic speaker may include a coil, magnets and a membrane. Excitation of the coil causes the coil to move relative to the magnets and to move the membrane, which produces sound.

BRIEF DESCRIPTION OF THE DRAWINGS

For a more complete understanding of the disclosure, reference should be made to the following detailed description and accompanying drawings wherein.

Figure 1:
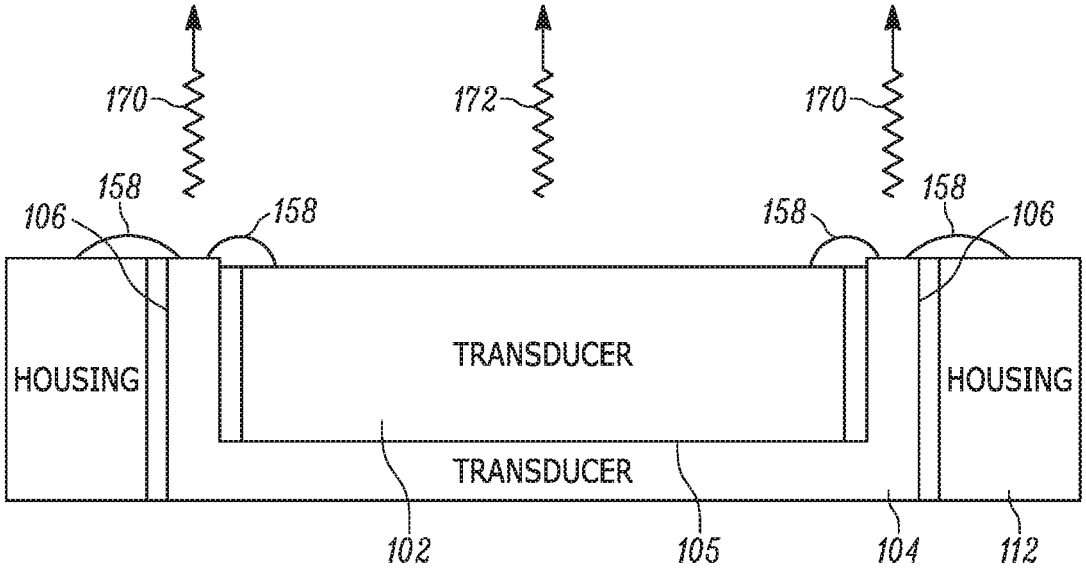
FIG. 1 is a block diagram of an acoustic apparatus.
Figure 2:
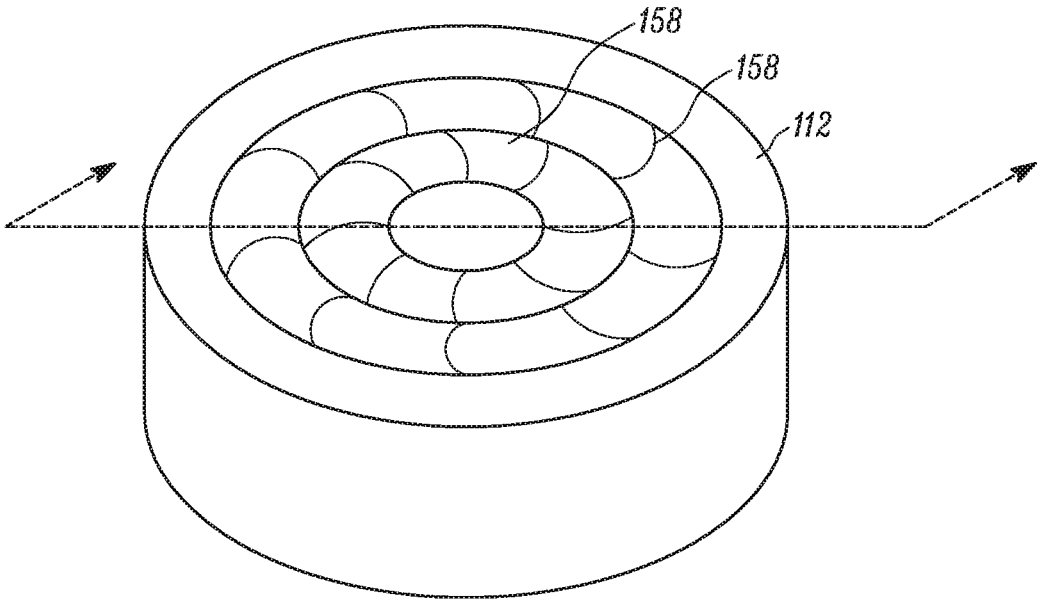
FIG. 2 is a perspective diagram of an acoustic apparatus.
Figure 3:
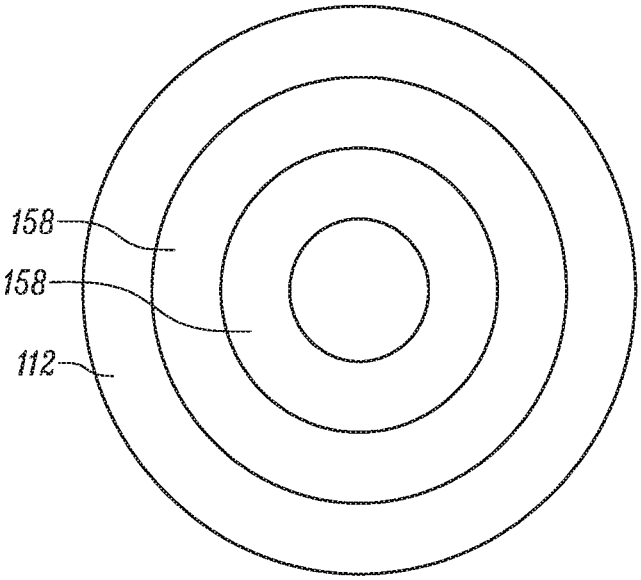
FIG. 3 is a top diagram of an acoustic apparatus.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While this disclosure is susceptible of embodiments in many different forms, there is shown in the drawings and will herein be described in detail several embodiments or implementations with the understanding that these embodiments are representative of the principles of the disclosure. The embodiments described herein are not representative of all possible implementations of the disclosure that will be apparent to those of ordinary skill in the art in light of the teachings herein, and thus the present disclosure is not intended to be limited to the embodiments described and illustrated.

In many of these embodiments, an acoustic device is provided that includes a first acoustic transducer and a second acoustic transducer. The first acoustic transducer has an armature. The armature moves within a magnetic field and the first transducer also includes a first coil. The second transducer has a first outer circumferential edge and an inner circumferential edge. A cavity is formed within the inner circumferential edge of the second acoustic transducer. A housing includes at least portions of the first acoustic transducer and the second acoustic transducer. The first transducer is disposed at least partially within the cavity and within the inner circumferential edge of the second acoustic transducer. The first coil is fixed in space relative to the housing.

In one aspect, the second acoustic transducer has a second moving coil. In another aspect, the inner circumferential edge of the second acoustic transducer forms an acoustic seal between a first side of the housing and a second side of the housing. In yet another aspect, the housing includes a second circumferential edge, and the second transducer is disposed within the second circumferential edge of the housing. In another example, the second coil moves with respect to the housing when an electrical current passes through the second coil. In other aspects, a membrane extends at least partially over the coil such that movement of the second coil is effective to displace the membrane and create sound energy.

In others of these embodiments, an acoustic device includes a first acoustic transducer and a second acoustic transducer. The first acoustic transducer also includes a first moving mass and the first moving mass is used to convert a first electrical current into first sound energy. The second acoustic transducer has a first outer circumferential edge and an inner circumferential edge. A cavity is formed within the inner circumferential edge of the second acoustic transducer. The second acoustic transducer also includes a second moving mass, and the second moving mass is used to convert a second electrical current into second sound energy. The first acoustic transducer is disposed at least partially within the cavity and within the inner circumferential edge of the second transducer. The first moving mass moves substantially in a first direction and the second moving mass moves substantially in a second direction. The first direction being substantially orthogonal to the second direction.

In some aspects, the first moving mass includes an armature and the armature is coupled to a driving rod at a first end and a diaphragm at a second end. In other aspects, the second moving mass comprises a moving coil.

Referring now to FIGS. 1-5, one example of an acoustic device 100 is described. The acoustic device 100 includes a first acoustic transducer 102 and a second acoustic transducer 104. The second acoustic transducer 104 defines a cavity 105 in which is disposed the first acoustic transducer 102.

The first acoustic transducer 102 has an armature 130 and in one example is a balanced armature transducer, which is also known as a balanced armature receiver ("BAR"). The armature 130 moves within a magnetic field created by magnets 132 and current moving through a first coil 134. Excitation of the first coil 134 with an electrical current (representative of sound energy) creates a changing magnetic field, which moves the armature 130, which moves drive rod 135, which moves a diaphragm (membrane) 136, which produces sound 172. In one example, the first acoustic transducer 102 provides sound signals 172 in the upper frequency range such as 4-5 kHz to 20 kHz (a tweeter). Other examples are possible.

The second acoustic transducer 104 has a first outer circumferential edge 106 and an inner circumferential edge 108. The second acoustic transducer 104 provides sound signals in the lower frequency ranges such as below 4-5 kHz (a woofer). The second acoustic transducer 104 includes a coil 150, a magnetic permeable material 152, and magnets 154. Electric current supplied to the coil 150 moves the coil 150 in the magnetic field created by the magnets 154. Movement of the coil 150 moves a coil former 156, which moves membrane 158 to produce sound 170. In one aspect, the second acoustic transducer 104 is a dynamic speaker.

The cavity 105 is formed within the inner circumferential edge 108 of the second acoustic transducer 104. A housing 112 includes at least portions of the first acoustic transducer 102 and the second acoustic transducer 104. The first acoustic transducer 102 is disposed at least partially within the cavity 105 and within the inner circumferential edge 108 of the second acoustic transducer 104. The first coil 134 (of the balanced armature transducer) is fixed in space relative to the housing 112. The membrane 158 may be attached to the housing 120 along rings 180.

Figure 4:
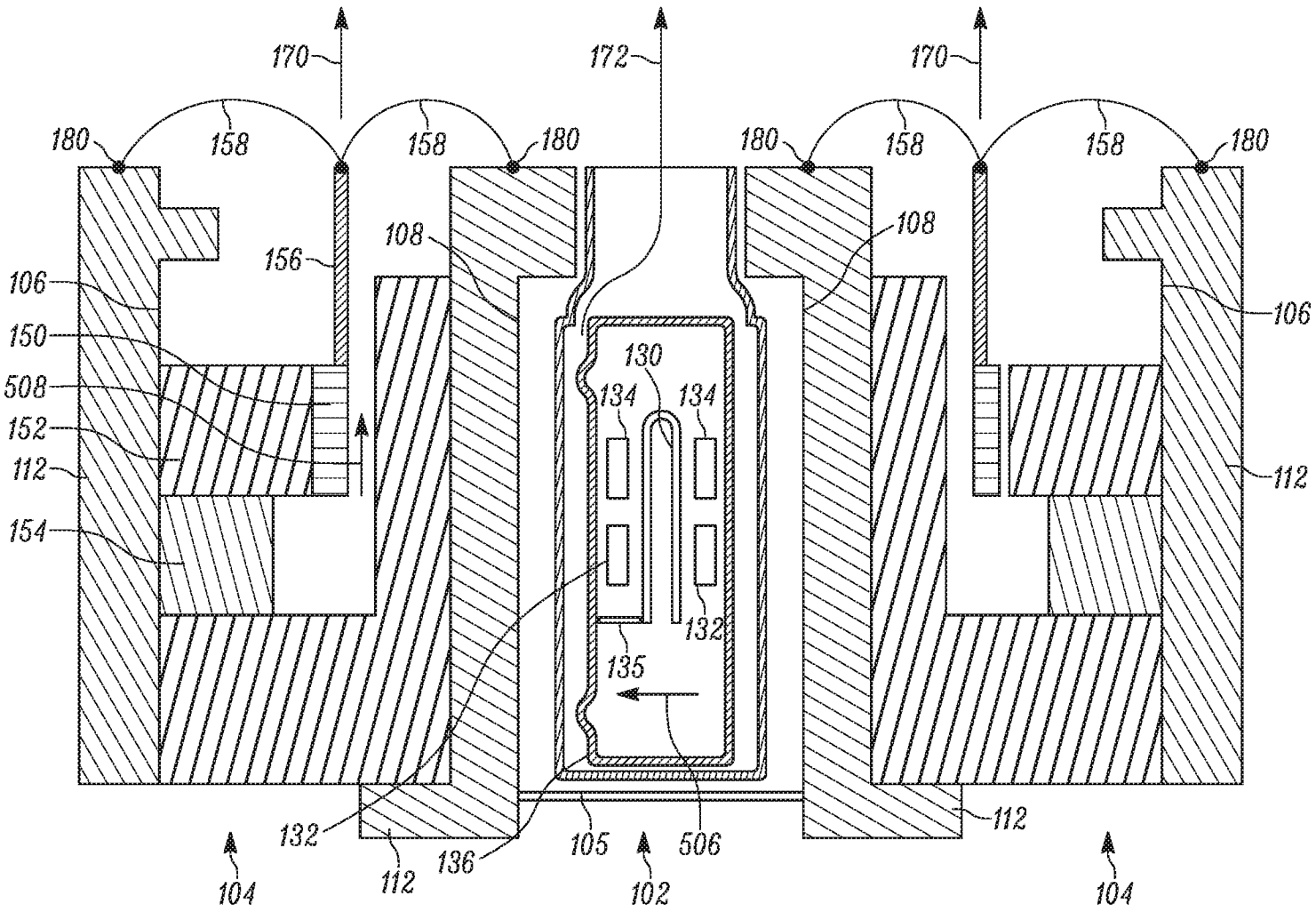
FIG. 4 is a side cutaway diagram of an acoustic apparatus.
Figure 5:
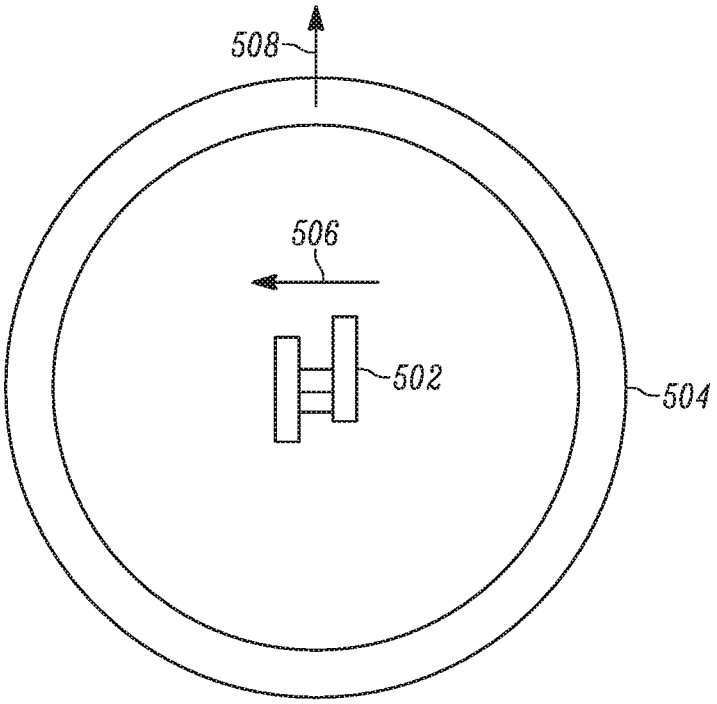
FIG. 5 is a block diagram of an acoustic apparatus showing the direction of movement of two moving masses.

Referring now especially to FIG. 4 and FIG. 5, aspects of the operation of the apparatus are described. FIG. 5 shows a first moving mass 502 and a second moving mass 504. The first moving mass 502 represents an armature (armature 130) that is moved. As an electrical coil is excited this moving mass 502 moves in the direction indicated by the arrow labeled 506.

The second moving mass 504 is the coil in the second (outer concentric ring) transducer (coil 150). As the coil is excited the coil moves in the direction indicated by the arrow labeled 508, which is perpendicular to the plane of the drawing page. FIG. 4 shows the movement of the coil 150 to be in the upward direction of arrow 170 and back down, while the armature 130 moves laterally between the magnets 132.

It can be seen that the arrows 506 and 508 are perpendicular (or generally perpendicular) to each other. That is, the direction of movement of each of the moving masses is generally orthogonal (or perpendicular) to each other.

It will be appreciated that the operation of the two transducers 102 and 104 combine to operate as a single transducer. That is, the inner balanced armature transducer may operate to produce sounds in a first frequency range and the second dynamic speaker may operate to produce sounds in a second frequency range. In so doing, the advantages of each speaker type are maximized, while the disadvantages of each speaker type are minimized.

Figure 6:
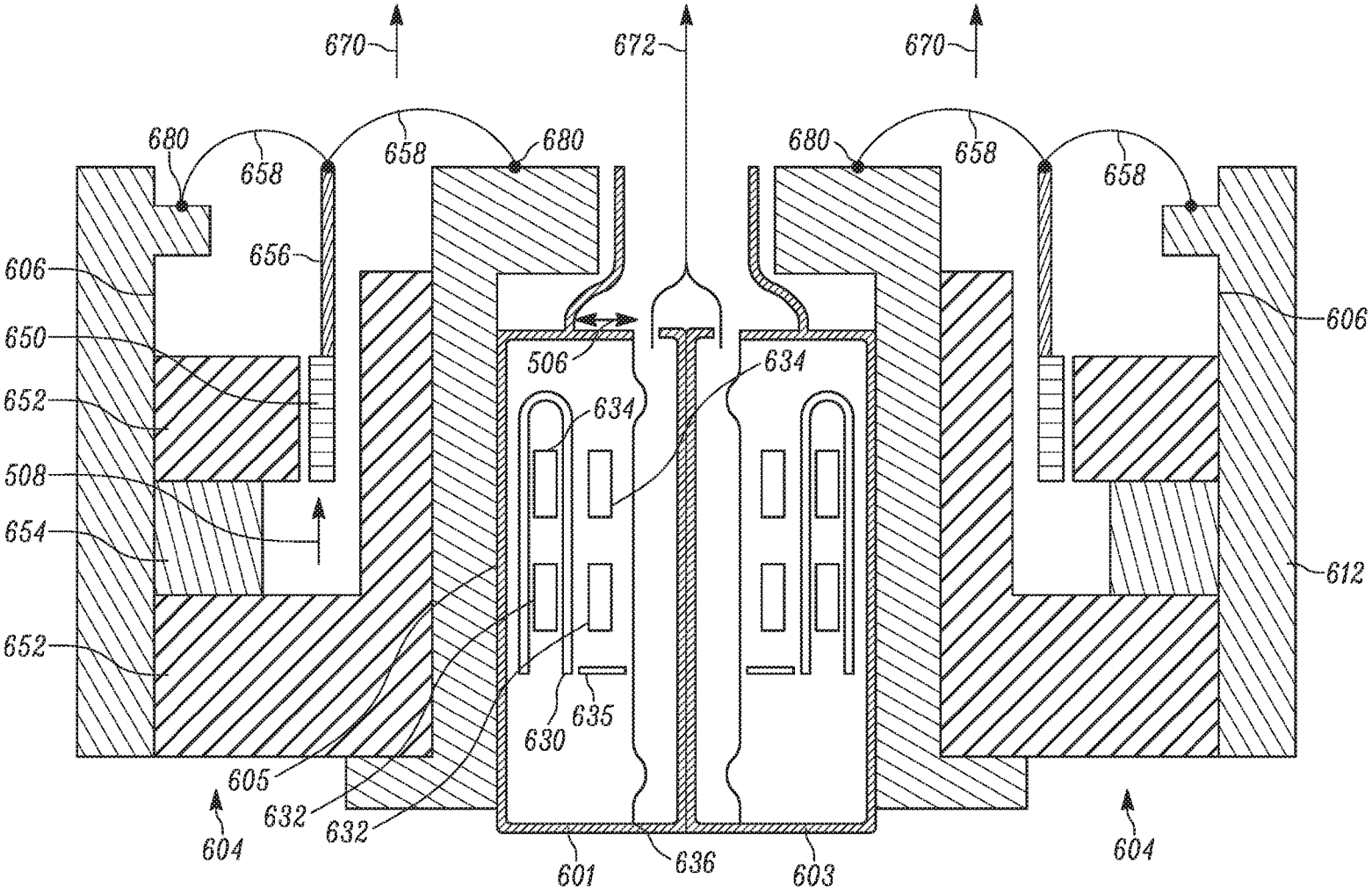
FIG. 6 is a side cutaway diagram of another example of an acoustic apparatus.

Referring now to FIG. 6, another example of a device including two balanced armature speakers 601 and 603 is described. In other words, the single balanced armature speaker is replaced with two balanced armature speakers. The speakers may operate in the 250 Hz or 500 Hz to 20 kHz range. Other examples are possible.

The acoustic device 600 includes a first acoustic transducer 601, a second acoustic transducer 603, and a third acoustic transducer 604. The third acoustic transducer 604 defines a cavity 605 in which is disposed the first acoustic transducer 601 and the second acoustic transducer 603.

The first and second acoustic transducers 601 and 603 each have an armature 630 and in one example are balanced armature transducers. For simplicity, FIG. 6 only shows that one of the transducers 601 and 603 with numeric labels but it will be appreciated that each speaker has the same parts and operates in the same way. The armature 630 moves within a magnetic field created by magnets 632 and current moving through a first coil 634. Excitation of the first coil 634 with an electrical current (representative of sound energy) creates a changing magnetic field, which moves the armature 630, which moves drive rod 635, which moves a diaphragm (membrane) 636, which produces sound 672. In one example, the first and second acoustic transducers 601 and 603 provide sound signals 672 in the upper frequency range such as 4-5 kHz to 20 kHz (a tweeter). Other examples are possible. The transducers 601 and 603 may produce sound in the same range or in different ranges (within an overall range).

The third acoustic transducer 604 has a first outer circumferential edge 606 and an inner circumferential edge 608. The third acoustic transducer 604 provides sound signals in the lower frequency ranges such as below 4-5 kHz (a woofer). The third acoustic transducer 604 includes a coil 650, a magnetic permeable material 652, and magnets 654. Electric current supplied to the coil 650 moves the coil 650 in the magnetic field created by the magnets 654. Movement of the coil 650 moves a coil former 656, which moves membrane 658 to produce sound 670. In one aspect, the third acoustic transducer 604 is a dynamic speaker.

The cavity 605 is formed within the inner circumferential edge 608 of the third acoustic transducer 604. A housing 612 may include at least portions of the first acoustic transducer 601, the second acoustic transducer 603, and the third acoustic transducer 604. The first and second acoustic transducers 601 and 603 are disposed at least partially within the cavity 605 and within the inner circumferential edge 608 of the third acoustic transducer 604. Each of the first coils 634 (of the balanced armature transducers) are fixed in space relative to the housing 612. The membrane 658 may be attached to the housing 620 along rings 680.

Figure 7:
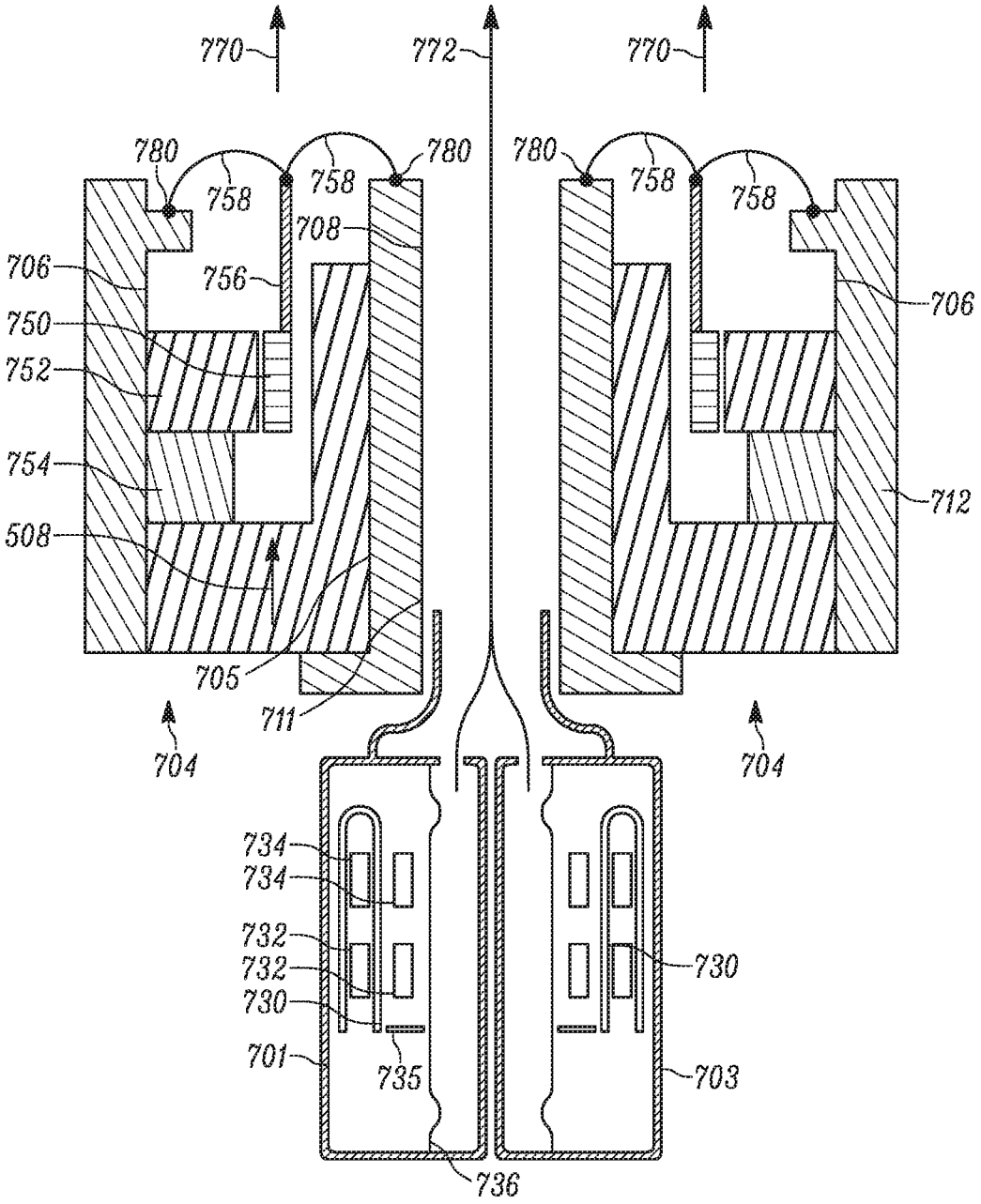
FIG. 7 is a side cutaway diagram of still another example of an acoustic apparatus.

Referring now to FIG. 7, another example of a device including two balanced armature speakers 701 and 703 is described. This example is similar to the example of FIG. 6 except that the two speakers 701 and 703 are not in the cavity formed by the dynamic speaker, but behind the cavity. The speakers 701 and 703 may operate in the 250 Hz or 500 Hz to 20 kHz range. Other examples are possible.

The acoustic device 700 includes a first acoustic transducer 701, a second acoustic transducer 703, and a third acoustic transducer 704. The third acoustic transducer 704 defines a cavity 705 in which is disposed a sound tube 711, which couples to the first acoustic transducer 701 and the second acoustic transducer 703.

The first and second acoustic transducers 701 and 703 each have an armature 730 and in one example are balanced armature transducers. For simplicity, FIG. 7 only shows that one of the transducers 701 and 703 with numeric labels but it will be appreciated that each speaker has the same parts and operates in the same way. The armature moves within a magnetic field created by magnets 732 and current moving through a first coil 734. Excitation of the first coil 734 with an electrical current (representative of sound energy) creates a changing magnetic field, which moves the armature, which moves drive rod 735, which moves a diaphragm (membrane) 736, which produces sound 772. In one example, the first and second acoustic transducers 701 and 703 provide sound signals 772 in the upper frequency range such as 4-5 kHZ to 20 kHz (a tweeter). Other examples are possible. The transducers 701 and 703 may produce sound in the same range or in different ranges (within an overall range).

The third acoustic transducer 704 has a first outer circumferential edge 706 and an inner circumferential edge 708. The second acoustic transducer 704 provides sound signals in the lower frequency ranges such as below 4-5 kHz (a woofer). The third acoustic transducer 704 includes a coil 750, a magnetic permeable material 752, and magnets 754. Electric current supplied to the coil 750 moves the coil 750 in the magnetic field created by the magnets 754. Movement of the coil 750 moves a coil former 756, which moves membrane 758 to produce sound 770. In one aspect, the third acoustic transducer 704 is a dynamic speaker.

The cavity 705 is formed within the inner circumferential edge 708 of the third acoustic transducer 704. A housing 712 may include at least portions of the first acoustic transducer 701, the second acoustic transducer 703, and the third acoustic transducer 704. The sound tube 711 is disposed at least partially within the cavity 705 and within the inner circumferential edge 708 of the second acoustic transducer 704. The first and second transducers 701 and 703 are disposed behind the sound tube 711 and behind the third transducer 704. Each of the first coils 734 (of the balanced armature transducers) are fixed in space relative to the housing 712. The membrane 758 may be attached to the housing 720 along rings 780.

Preferred embodiments are described herein, including the best mode known to the inventors. It should be understood that the illustrated embodiments described herein are exemplary only, and should not be taken as limiting the scope of the appended claims.

What is claimed is:

1. An acoustic device comprising:

a first acoustic transducer having a first diaphragm linked to an armature movable relative to a first magnet in response to an excitation signal applied to a first coil, the first acoustic transducer having an acoustic output port;

a second acoustic transducer having a second diaphragm movable relative to a housing portion of the second acoustic transducer in response to an excitation signal applied to a second coil, the housing portion of the second acoustic transducer defining a cavity with an opening about which the second diaphragm is disposed;

the first acoustic transducer disposed at least partially within the cavity of the second acoustic transducer, the first acoustic transducer positioned within the cavity so that sound emanating from the acoustic output port emanates from the opening in the cavity; and a diaphragm of the first acoustic transducer disposed behind plane of the second diaphragm.

2. The acoustic device of claim 1, wherein the housing portion comprises an outer circumferential edge, the second diaphragm disposed within the outer circumferential edge of the housing portion.

3. The acoustic device of claim 1, the second coil coupled to the second diaphragm, wherein the second coil is movable together with the second diaphragm relative to the housing portion in response to the excitation signal applied to the second coil.

4. The acoustic device of claim 3, the first acoustic transducer is a balanced armature receiver and the second acoustic transducer is a dynamic speaker.

5. The acoustic device of claim 1, the second acoustic transducer has a substantially annular shape with an outer circumferential portion, the second diaphragm has a substantially annular shape with a central opening aligned with the opening of the cavity.

6. The acoustic device of claim 5, the first acoustic transducer including a first mass movable in a first direction in response to the excitation signal applied to the first coil;

the second acoustic transducer including a second mass movable in a second direction in response to the excitation single applied to the second coil, wherein the first direction is substantially perpendicular to the second direction.

7. The acoustic device of claim 1, the housing portion comprises a portion of the first acoustic transducer and a portion of the second acoustic transducer.

8. The acoustic device of claim 1, the housing portion comprises a sound tube of the first acoustic transducer, the sound tube having an acoustic output acoustically coupled to the first diaphragm.

9. The acoustic device of claim 1 wherein the first acoustic transducer is disposed at least partially behind the second diaphragm.

10. An acoustic device comprising:

a first electro-acoustic transducer including a first mass linked to a first diaphragm, the first mass movable in response to an excitation signal applied to a first coil;

a second electro-acoustic transducer including a second mass coupled to a second diaphragm, the second mass movable in response to an excitation signal applied to a second coil, the second electro-acoustic transducer including a cavity having an opening about which the second diaphragm is disposed;

the first electro-acoustic transducer disposed at least partially within the cavity of the second electro-acoustic transducer, wherein the second diaphragm does not obstruct sound emanating from the acoustic output port of the first transducer via the opening of the cavity;

the first mass movable in a first direction and the second mass movable in a second direction, the first direction non-parallel to the second direction; and a diaphragm of the first acoustic transducer disposed behind a plane of the second diaphragm.

11. The acoustic device of claim 10, the first mass comprises an armature, the armature linked to the first diaphragm, and the second mass comprises a voice coil, the voice coil coupled to the second diaphragm.

12. The acoustic device of claim 11, an acoustic output of the first electro-acoustic transducer and the second diaphragm emanating sound in a common direction.

13. The acoustic device of claim 12, the second diaphragm is substantially annular with an opening aligned with the opening of the cavity.

14. The acoustic device of claim 13, the first electro-acoustic transducer is a self-contained balanced armature receiver and the second electro-acoustic transducer is a dynamic speaker.

15. The acoustic device of claim 14, the first electro-acoustic transducer and the second electro-acoustic transducer constitute part of an earphone.

16. The acoustic device of claim 14, the first electro-acoustic transducer and the second electro-acoustic transducer constitute part of a headphone.

17. The acoustic device of claim 10 further comprises a housing portion constituting a part of the first acoustic transducer and a part of the second acoustic transducer.

18. The acoustic device of claim 17, the housing portion comprises a sound tube of the first acoustic transducer, the sound tube having an acoustic output acoustically coupled to the first diaphragm.

19. The acoustic device of claim 10 wherein the first acoustic transducer is disposed at least partially behind the second diaphragm.

* * * * *